US005236628A

United States Patent [19]

Capp

[11] Patent Number: 5,236,628

[45] Date of Patent: Aug. 17, 1993

[54] NOBLE METAL AND SOLID-PHASE LUBRICANT COMPOSITION AND ELECTRICALLY CONDUCTIVE INTERCONNECTOR

[75] Inventor: Patrick O. Capp, Woonsocket, R.I.

[73] Assignee: Metallon Engineered Materials Corporation, Pawtucket, R.I.

[21] Appl. No.: 661,872

[22] Filed: Feb. 27, 1991

[51] Int. Cl.[5] ..... H01B 1/04

[52] U.S. Cl. ..... 252/503

[58] Field of Search ..... 252/503, 514, 512, 23, 252/16, 19, 46.4, 500; 439/87, 88

[56] References Cited

U.S. PATENT DOCUMENTS

| | | | |
|---|---|---|---|
| 1,739,631 | 12/1929 | Cross et al. | 252/23 |
| 3,767,750 | 10/1973 | Groszek et al. | 264/105 |
| 4,199,381 | 4/1980 | Nuss et al. | 252/23 |
| 4,206,060 | 6/1980 | Yamamoto et al. | 252/22 |
| 4,557,839 | 12/1985 | Tubbs et al. | 252/23 |
| 4,699,763 | 10/1987 | Sinharoy et al. | 252/503 |

FOREIGN PATENT DOCUMENTS 0165584 12/1985 European Pat. Off. .

*Primary Examiner*—Mark L. Bell
*Assistant Examiner*—A. Wright
*Attorney, Agent, or Firm*—Hamilton, Brook, Smith & Reynolds

[57] ABSTRACT

A noble metal and solid-phase lubricant composition and an an electrically conductive interconductor including the electrically conductive composition are disclosed. The electrically conductive composition includes a noble metal component and a solid-phase lubricant component. The solid-phase lubricant component is present in an amount sufficient to cause the electrically conductive composition to have a coefficient of friction which is significantly lower than the coefficient of friction of the noble metal component without causing the electrically conductive composition to be significantly less malleable than the noble metal component, nor to be significantly less corrosion resistant than the noble metal component. The electrically conductive composition can form a contact layer of the electrically conductive interconnector. The contact layer is bonded to a diffusion barrier which, in turn, is bonded to a bulk electrical conductor of the electrically conductive interconnector.

9 Claims, 2 Drawing Sheets

NOBLE METAL AND SOLID-PHASE LUBRICANT COMPOSITION AND ELECTRICALLY CONDUCTIVE INTERCONNECTOR

BACKGROUND OF THE INVENTION

Many electrical and electronic devices (such as electronic connectors and switches) must exhibit very high reliability. For example, switches that are used to trigger the release of automobile air bags often are required to remain operational, despite non-use, over extended periods of time. In another example, electronic connectors used in high-speed data transmission at conditions which include relatively low-voltage and low-current generally must operate without failure in order to prevent interruptions in data transmission. However, electrically conductive interconnectors within such devices typically are formed of metals which can corrode after wear at surfaces exposed to the atmosphere. Corrosion at surfaces where contact is made often significantly reduces the lifetime reliability of electronic devices which include such interconnectors.

One attempt to improve the reliability of electronic devices is to bond a relatively non-corrosive electrically conductive contact layer to electrically conductive interconnectors at surfaces where contact, such as during switch closure. Contact layers are typically formed of a noble metal or an alloy thereof. However, noble metals are relatively expensive. As a result, contact layers generally are fabricated to be as thin as possible without causing failure under expected use-conditions. Also, noble metals are relatively soft and, therefore, can wear away during repeated operation of electronic devices. The relatively corrosive metal beneath the contact layers can thereby be exposed to the atmosphere, ultimately causing failure of these electronic devices.

Liquid lubricants have been applied to surfaces of contact layers in an attempt to reduce wear. However, many liquid lubricants are considered hazardous, especially during their application, which often involves use of volatile chlorinated hydrocarbon dispersants. In addition, liquid lubricants can become unevenly distributed on contact layer surfaces and can evaporate or creep away, thereby causing portions of the contact layers to be exposed to conditions which can result in excessive wear and consequent premature failure. Additionally, liquid phase lubricants typically attract dust and abrasive particles from the atmosphere which accelerate wear and corrosion in the contact area, thereby resulting in significantly reduced contact reliability. Also, many liquid lubricants are relatively poor electrical conductors, thereby causing relatively high electrical resistance across closed contact surfaces and possible failure of electronic devices which include such contact surfaces.

Solid-phase lubricants have also been applied to the surfaces of contact layers in an attempt to reduce wear. Commonly used solid-phase lubricants include graphite, molybdenum disulfide and various plastics. Typically, these have been applied by air-spraying, sputtering and ion plating. However, the wear durability of these surface coatings is limited because the motion of sliding contacts tends to plow away the solid-phase lubricant from the wear track, thereby leaving a pile-up of lubricant and wear-debris at the ends of the wear track. Also, solid-phase lubricants typically are poor electrical conductors, thereby causing high electrical resistance across contact surfaces which come to rest upon a particle of the solid-phase lubricant.

Thus, a need exists for an electrically conductive composition and an electrically conductive interconnector which overcome or minimize the above-mentioned problems.

SUMMARY OF THE INVENTION

The present invention relates to a new electrically conductive composition and a new electrically conductive interconnector for an electrical circuit.

An electrically conductive composition includes a noble metal component and a solid-phase lubricant component. The solid-phase lubricant component is present in an amount sufficient to cause the electrically conductive composition to have a coefficient of friction which is significantly lower than the coefficient of friction of the noble metal component without causing the electrically conductive composition to be significantly less malleable than the noble metal component.

An electrically conductive interconnector for an electrical circuit includes a bulk electrical conductor and a diffusion barrier which is bonded to a surface of the bulk electrical conductor, whereby significant diffusion of the bulk electrical conductor across the diffusion barrier is prevented. A contact layer is bonded to the diffusion barrier, the contact layer being formed of an electrically conductive composition including a noble metal component and a solid-phase lubricant component. The solid-phase lubricant component is present in an amount sufficient to cause the electrically conductive composition to have a coefficient of friction which is significantly lower than the coefficient of friction of the noble metal component without causing the electrically conductive composition to be significantly less malleable than the noble metal component.

The present invention has many advantages. The noble metal component is relatively non-corrosive, thereby preventing significant corrosion at the contact layer. The solid-phase lubricant component will not evaporate or creep away. In addition, the solid-phase lubricant component causes the contact layer to have a coefficient of friction which is significantly lower than that of the noble metal component of the composition. Wear of the contact layer during opening and closing of an electronic device including an electrically conductive interconnector of the invention is thereby significantly diminished. As a result, the probability of failure of the contact layer and subsequent failure of the electronic device is significantly reduced. Also, the amount of solid-phase lubricant component present does not cause the malleability of the composition to be significantly less than that of the noble metal component of the composition. Contact layers formed of the electrically conductive composition can thereby be fabricated using known methods of forming contact layers which include noble metals.

DETAILED DESCRIPTION OF THE INVENTION

The features and other details of the composition and of the electrically conductive interconnector of the invention will now be more particularly described with reference to the accompanying drawings and pointed out in the claims. The same number present in different figures represents the same item. It will be understood that the particular embodiments of the invention are shown by way of illustration and not as limitations of the invention. The principle features of this invention can be employed in various embodiments without departing from the scope of the invention.

Figure 1:
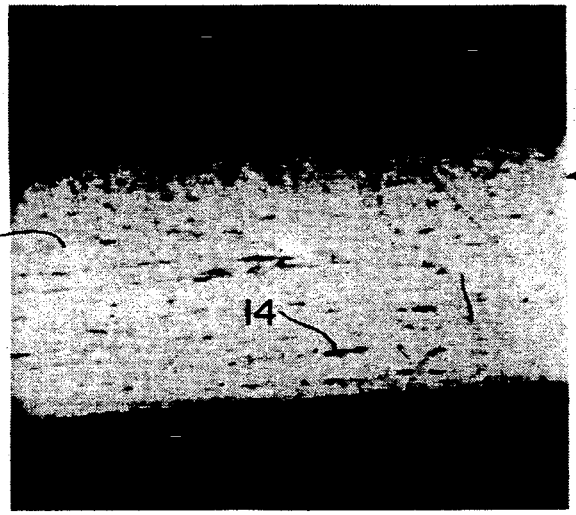
FIG. 1 is a photograph of an electrically conductive composition of the invention magnified about three hundred times.

In one embodiment of the invention, shown in FIG. 1, an electrically conductive composition 10 includes a noble metal component 12 and a solid-phase lubricant component 14. Electrically conductive composition 10 is suitable for use as a contact layer of an electrically conductive interconnector in an electronic device, not shown.

A suitable noble metal component 12 can include, for example, noble metals and alloys thereof which are suitable for forming an electrically conductive contact layer of an electrical interconnector. Examples of suitable noble metals for use in noble metal component 12 include gold, silver, platinum, palladium, etc#An example of a suitable noble metal alloy is a noble metal including about sixty-nine percent gold, about twenty-five percent silver and about six percent platinum, by weight. In a particularly preferred embodiment, noble metal component 12 is gold.

A suitable solid-phase lubricant component 14 is a solid at the expected use-conditions of an electrically conductive interconnector and can cause electrically conductive composition 10 to have a coefficient of friction which is significantly lower than the coefficient of friction of noble metal component 12 without causing significantly less malleability of electrically conductive composition 10 than noble metal component 12. Also, the solid-phase lubricant does not cause the resulting electrically conductive composition to be significantly less corrosion resistant than the noble metal component. In a particularly preferred embodiment, the amount of solid-phase lubricant present is sufficiently low to cause the electrical resistance of the electrically conductive composition to be less than ten percent greater than the electrical resistance of the noble metal component of the electrically conductive composition.

A "significantly lower coefficient of friction," as that phrase is used herein, means a coefficient of friction which is sufficiently lower than the coefficient of friction of noble metal component 12 to allow significantly reduced wear of electrically conductive composition 10 during formation of an electrical interconnection. Preferably, the coefficient of friction of electrically conductive composition 10 is less than about 50% that of noble metal component 12.

An example of wear is loss of a portion of electrically conductive composition 10 of a contact layer by contacting the contact layer with a mating contact surface, not shown, of an electrical conductor to thereby form an electrical interconnection. In one embodiment, wear is significantly reduced when the contact layer can contact a bulk electrical conductor at least twice as many times as can a contact layer formed of noble metal component 12 alone, without exposing the material to which the contact layer is bonded to conditions sufficient to corrode the material in an amount sufficient to prevent electrical conduction across the bulk electrical conductor.

"Without causing significantly less malleability than the noble metal component," as that phrase is used herein, means that malleability is sufficient to allow forming of a material, such as electrically conductive composition 10, into a contact layer having the same thickness as a contact layer formed only of noble metal component 12. Preferably, electrically conductive composition 10 has a malleability which is sufficient to allow bonding and rolling without cracking. A typical measure of malleability is a bend test, such as the standard Longitudinal Bend Test (ASTM E290, Arrangement C, FIG. 6, described by the American Society for Testing and Materials (hereinafter "ASTM")). Material which meets this test is capable of forming a 180° bend angle with a bend radius equal to the material thickness without cracking of the materials.

In one embodiment, solid-phase lubricant 14 is a suitable carbon-containing compound. Preferably, the carbon-containing compound is graphite having a particle size of less than about one micron following formation of electrically conductive composition 10. The amount of solid-phase lubricant component 14 present in electrically conductive composition 10 is sufficient to cause electrically conductive composition 10 to have a coefficient of friction which is significantly lower than that of noble metal component 12 without causing electrically conductive composition 10 to be significantly less malleable than noble metal component 12. For example, when noble metal component 12 includes gold and solid-phase lubricant component 14 includes graphite, the graphite is preferably present in electrically conductive composition 10 in an amount in the range of between about 0.01 and about ten percent by weight. In a particularly preferred embodiment, the graphite is present in an amount in the range of between about 0.1 and about one percent by weight.

Noble metal component 12 and solid-phase lubricant component 14 are combined to form electrically conductive composition 10 by a suitable method, such as by powder compaction, a method known in the art. For example, in one illustration of forming electrically conductive composition 10, a gold powder having a particle size in the range of between about 2 and about 20 microns is mixed by a suitable method with graphite powder having a particle size of about 10 microns. The combined gold and graphite powder can be mixed in a suitable powder mixture apparatus, such as is known in the art.

The mixture of gold and graphite powder is poured into a metal die or a rubber mold and exposed to a pressure of about $1\times10^5$ psi by a suitable means to form a powder compact which is suitable for sintering. Preferably, the powder compact has dimensions of about one by two by twelve inches. Alternatively, the powder may be compacted in the form of a cylinder having a diameter of about four inches and a length of about twelve inches. An example of a suitable means for compressing the gold and graphite powder mixture is an isostatic hydraulic press, such as is known in the art.

The powder compact is then sintered in an inert atmosphere, such as argon or nitrogen, in a suitable sealed furnace to form a sintered bar. An example of a suitable furnace is an electrically heated furnace, such as is known in the art. The powder compact is sintered in the furnace at a temperature in the range of between about 800° C. and about 1000° C. and at about atmospheric pressure for a period of time sufficient to cause the powder compact to be formed into a sintered bar having a density which is at least ninety-eight percent of the theoretical density of the gold and graphite mixture. Preferably the powder compact is sintered for a period of time in the range of between about one and about twelve hours.

The sintered bar is subsequently cooled to about room temperature and rolled by a suitable rolling mill under a pressure of at least about $1\times10^5$ psi to form a rolled bar. An example of a suitable rolling mill is a Stanat Model TA-315 rolling mill, commercially available from Stanat Manufacturing Co., Inc. The thickness of the sintered bar is reduced by rolling from about one inch to about one-half inch.

Following rolling, the rolled bar can be machined by a suitable means if needed to remove rough edges to form a rolled and machined bar. An example of a suitable means for machining the rolled bar is a Model 146 rotary shear slitting machine, commercially available from Ruesch Machine Co.

The rolled and machined bar is then annealed by exposing the bar to a temperature in the range of between about 800° C. and about 1000° C. in an inert atmosphere for a period of time in the range of between about one and about four hours. Rolling, slitting and annealing are repeated until a contact layer strip is formed of electrically conductive composition 10, wherein the contact layer strip has a thickness in the range of between about $3\times10^{-3}$ and about $3\times10^{-2}$ inches. Preferably, the sequence of rolling, slitting and annealing is repeated between about five and about seven times.

The contact layer strip can be rolled after the last annealing iteration. In addition, the contact layer strip can be flattened by a suitable method, such as is known in the art, to remove waves and ripples from the strip. The contact layer strip is then slit to a suitable width for forming a contact layer.

Figure 2:
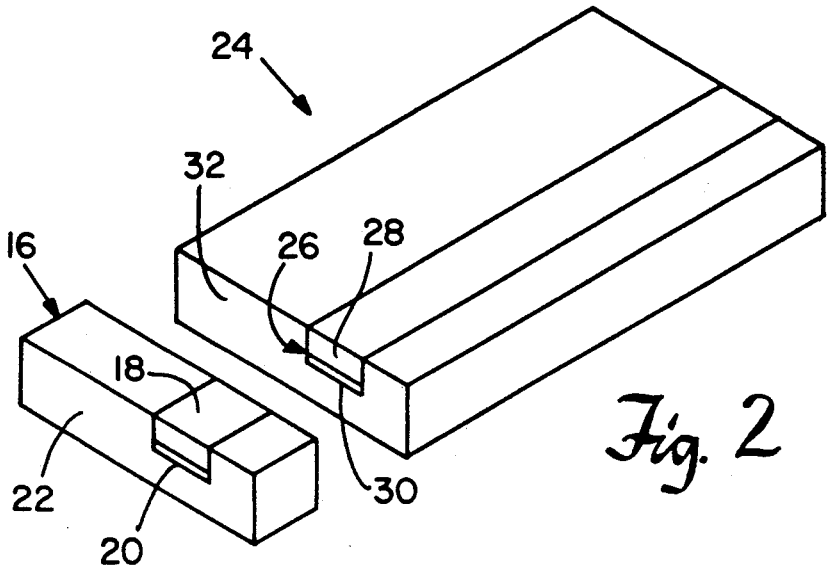
FIG. 2 is a perspective view of one embodiment of an electrically conductive interconnector of the invention and of a bonded metal strip from which the electrically conductive interconnector has been formed.

In one embodiment of the invention, shown in FIG. 2, electrically conductive interconnector 16 includes contact layer 18 which is formed of the electrically conductive composition of the invention, as described above. Contact layer 18 is bonded to diffusion barrier 20 which is, in turn, bonded to bulk conductor 22. Electrically conductive interconnector 16 is suitable for forming an electrical interconnection, such as in an electronic device, to close a circuit, not shown. Contact is established during formation of the electrical interconnection at contact layer 18 so that an electrical current can be conducted across electrically conductive interconnector 16.

Electrically conductive interconnector 16 is formed from bonded metal strip 24, which is also shown in FIG. 2. Bonded metal strip 24 includes bonded inlay strip 26, which is formed of contact layer strip 28 and diffusion barrier strip 30. Contact layer strip 28 is formed by the method described above and includes the electrically conductive composition of the invention, which is also described above.

Diffusion barrier strip 30 is formed of an electrically conductive material which is suitable for forming diffusion barrier 20. Diffusion barrier 20 prevents significant diffusion of an electrically conductive bulk conductor material of bulk conductor 22 across diffusion barrier 20 to contact layer 18. Examples of suitable materials for forming diffusion barrier strip 30 include nickel, palladium, silver, or an alloy thereof. Preferably, the material includes nickel having a purity of at least 99.8% by weight. In one embodiment, diffusion barrier strip 30 has about the same width as contact layer 18 and has a thickness in the range of between about $1\times10^{-4}$ and about $1\times10^3$ inches. Preferably, the diffusion barrier strip 30 has a thickness of about $5\times10^{-4}$ inches.

Contact layer strip 28 is bonded to diffusion barrier strip 30 by a suitable method, such as is known in the art. An example of a suitable method of bonding contact layer strip 28 to diffusion barrier strip 30 is by metallurgical adhesion, wherein contact layer strip 28 and diffusion barrier strip 30 are overlaid and co-rolled by a suitable rolling mill under a pressure of at least about $1\times10^5$ psi. Preferably, the pressure applied during rolling reduces the combined thickness of contact layer strip 28 and diffusion barrier strip 30 by an amount in the range of between about 50% and about 70%. Rolling causes contact layer strip 28 to adhere to diffusion barrier strip 30, thereby forming bonded inlay strip 26.

Bonded inlay strip 26 is then successively annealed and rolled by the same method described above with regard to contact layer strip 28 until contact layer strip 28 has a suitable thickness to form contact layer 18. For example, bonded inlay strip 26 has a thickness after rolling and annealing which is in the range of between about $1\times10^{-3}$ and about $1\times10^{-2}$ inches. After rolling and annealing, bonded inlay strip 26 is slit to remove burrs and rough edges of bonded inlay strip 26.

Bonded inlay strip 26 is then inlaid into metal strip 32 within recessed portion 34 of metal strip 32. Metal strip 32 is formed of a material which is suitable for forming bulk electrical conductor 22. Examples of suitable materials of metal strip 32 include copper and alloys thereof, nickel and alloys thereof, etc. Preferably, the material includes copper. Particularly preferred materials include UNS C19400, C51000, C72500. In one embodiment, metal strip 32 includes copper and has a width of about six inches and a thickness of about 0.1 inches.

Recessed portion 34 is formed by a suitable method, such as is known in the art. An example of a suitable method of forming recessed portion 34 is skiving. The depth of recessed portion 34 is about equal to the thickness of bonded inlay strip 26.

Bonded inlay strip 26 is then inlaid into recessed portion 34 of metal strip 32. Bonded inlay strip 26 and metal strip 32 are subsequently rolled and annealed to bond diffusion barrier strip 30 to metal strip 32 and to form bonded metal strip 24 into the finished thickness. Preferably, the finished thickness of bonded metal strip 24 is in the range of between about $5\times10^{-3}$ and about $5\times10^{-2}$ inches, and contact layer 18 has a thickness in the range of between about $5\times10^{-6}$ and about $1.5\times10^{-3}$ inches. In a particularly preferred embodiment, contact layer has a thickness of about $5\times10^{-5}$ inches. Bonded metal strip 24 can then be formed by suitable methods, such as punching, blanking, stamping, drawing, bending, as is known in the art, to form electrically conductive interconnector 16.

Figure 3:
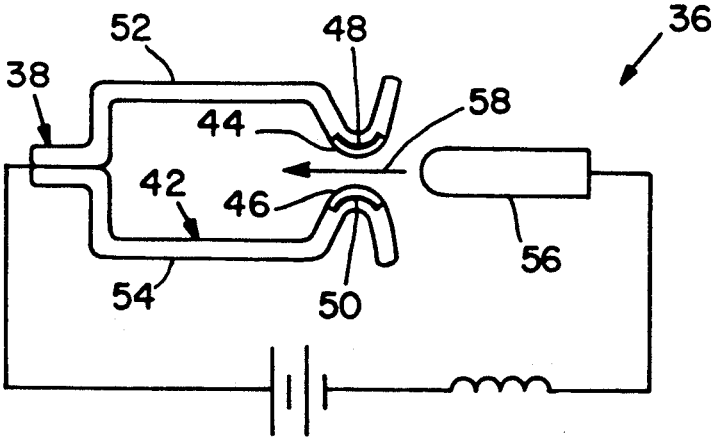
FIG. 3 is a section view of the electrically conductive interconnector shown in FIG. 2 as employed in an electrical circuit which is in an opened position.

In another illustration of the invention, shown in FIG. 3, electrical circuit 36 includes electrical interconnection device 38. Electrical device 38 has electrically conductive interconnectors 40,42, which are oriented so that contact layers 44,46 are facing each other. Contact layers 44,46 are formed of the electrically conductive composition of the invention, described above.

Figure 4:
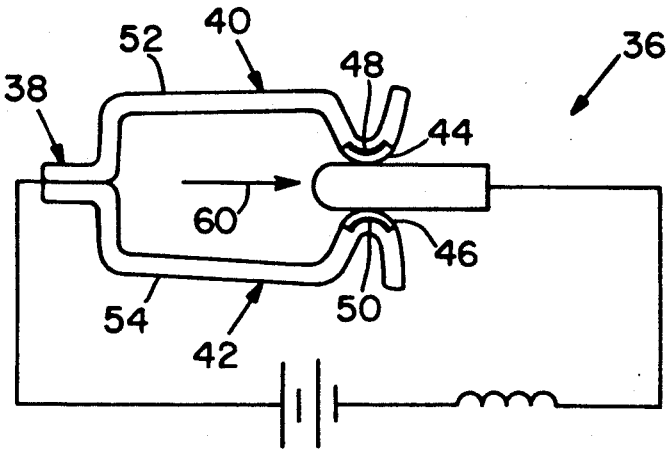
FIG. 4 is a section view of the electrical circuit shown in FIG. 3 in a closed position.

Diffusion barriers 48,50 are interposed between contact layers 44,46 and bulk electrical conductors 52,54 of electrically conductive interconnectors 40,42. Bulk electrical conductors 52,54 are configured to allow positive normal force by electrical conductors 52,54 on electrical conductors 56 to cause contact between contact layers 44,46 and electrical conductor 56 during advancement of electrical conductor 56 in a direction illustrated by arrow 58. Electrical circuit 38 is thereby directed from a position wherein electrical circuit 36 is opened, as shown in FIG. 3, to a position wherein electrical circuit 36 is closed, as shown in FIG. 4. An example of a suitable electrical conductor 56 is an electrical conductor formed of a copper alloy which has been electroplated with a nickel layer and a gold layer.

Advancement of electrical conductor 56 to close electrical circuit 36 and retraction of electrical conductor 56, illustrated by arrow 60, to open electrical circuit 36 causes electrical conductor 56 to move across contact layers 44,46. The coefficient of friction of contact layers 44,46 is significantly lower than the noble metal component of the electrically conductive composition forming contact layers 44,46. Therefore, movement of electrical conductor 56 across contact layers 44,46 to open or close electrical circuit 36 results in significantly less wear of contact layers 44,46 than would occur if contact layers 44,46 were formed of only the noble metal component of the electrically conductive composition.

EQUIVALENTS

Those skilled in the art will recognize, or be able to ascertain using no more than routine experimentation, many equivalents to specific embodiments of the invention described specifically herein. Such equivalents are intended to be encompassed in the scope of the following claims.

I claim:

1. An electrically conductive composition, comprising:

a) a noble metal component; and b) a solid-phase lubricant component present in an amount in the range of about 0.1–5.0 percent by weight whereby the electrically conductive composition has a coefficient of friction which is significantly lower than the coefficient of friction of the noble metal component without causing the electrically conductive composition to be significantly less malleable than the noble metal component.

2. An electrically conductive composition of claim 1 wherein the noble metal component includes gold.

3. An electrically conductive composition of claim 2 wherein the solid-phase lubricant component includes a carbon-containing compound.

4. An electrically conductive composition of claim 3 wherein the carbon-containing compound includes graphite.

5. An electrically conductive composition of claim 4 wherein the graphite has an average particle size of less than about one micron.

6. An electrically conductive composition of claim 5 wherein the noble metal component is an alloy of gold which further includes silver.

7. An electrically conductive composition of claim 6 wherein the alloy further includes platinum.

8. An electrically conductive composition of claim 7 wherein the alloy further includes palladium.

9. In an electrically conductive composition including a noble metal component:

The improvement comprising a solid-phase lubricant component present in the electrically conductive material in an amount in the range from about 0.1 and 5.0 percent by weight to form an electrically conductive composition having a coefficient of friction which is significantly lower than the coefficient of friction of the noble metal component without causing the electrically conductive composition to be significantly less malleable than the noble metal component.

* * * * *